US011590404B2

(12) United States Patent
Lewis

(10) Patent No.: US 11,590,404 B2
(45) Date of Patent: Feb. 28, 2023

(54) FLAG FOOTBALL MARKER

(71) Applicant: AFFL Associates, Inc., New York, NY (US)

(72) Inventor: Jeffrey Lewis, New York, NY (US)

(73) Assignee: AFFL Associates, Inc., New York, NY (US)

( * ) Notice: Subject to any disclaimer, the term of this patent is extended or adjusted under 35 U.S.C. 154(b) by 0 days.

(21) Appl. No.: 17/526,848

(22) Filed: Nov. 15, 2021

(65) Prior Publication Data

US 2022/0241669 A1 Aug. 4, 2022

Related U.S. Application Data

(63) Continuation of application No. 16/266,599, filed on Feb. 4, 2019, now Pat. No. 11,173,374.

(60) Provisional application No. 62/626,617, filed on Feb. 5, 2018.

(51) Int. Cl.
*A63B 71/06* (2006.01)

(52) U.S. Cl.
CPC ..... *A63B 71/0622* (2013.01); *A63B 71/0605* (2013.01); *A63B 2071/0625* (2013.01); *A63B 2243/007* (2013.01)

(58) Field of Classification Search
None
See application file for complete search history.

*Primary Examiner* — Kevin Y Kim
(74) *Attorney, Agent, or Firm* — Morrison & Foerster LLP

(57) ABSTRACT

An electronic sideline marker for use in football comprises a first display configured to display an indication of a down and a second display configured to display one or more timers. The second display may be configured to display a play clock, a go-clock, and/or a throw-clock. A play clock may first be displayed, and the marker may then receive an indication (e.g., a button press) that the football has been snapped, at which point display of the play clock may be replaced with display of a go-clock. The marker may be configured to output indications when the play clock, go-clock, and/or throw-clock expire. The marker may be configured to electronically communicate with one or more other markers for use in the football game, or one or more other remote electronic devices such as sensors in flag football belts, flags, and/or footballs.

20 Claims, 5 Drawing Sheets

FLAG FOOTBALL MARKER

CROSS REFERENCE TO RELATED APPLICATIONS

This application is a continuation of U.S. application Ser. No. 16/266,599, filed Feb. 4, 2019, which claims the benefit of U.S. Provisional Application No. 62/626,617, filed Feb. 5, 2018, the entire contents of each of which are incorporated herein by reference.

FIELD OF THE DISCLOSURE

This disclosure relates generally to flag football equipment and, more specifically, to an electronic sideline marker for use in flag football.

BACKGROUND OF THE DISCLOSURE

Flag football is a type of gridiron football (American football) in which players wear flags that are attached to belts worn around the waist. When a player on the defense grabs and pulls on the flag of an offensive player who is advancing the ball, the flag detaches from the offensive player's belt and play is halted. Flag football may provide a safer alternative to tackle football, because high-impact collisions are not an integral part of the game.

In certain forms of flag football, as in many forms of tackle football, the offensive team may have a limited amount of time in which it is required to snap the ball to avoid being penalized for delay of game; in many forms of tackle football, this rule is enforced via use of a play clock integrated into an electronic scoreboard or another fixed stadium feature.

Additionally, in certain forms of flag football, rules regarding rushing and or downing the quarterback may differ from rules in tackle football. For example, flag football rules may dictate a period of time following the snap of the football during which defensive players are prohibited from rushing the quarterback. Furthermore, flag football rules may dictate a period of time following the snap of the football after which the quarterback may be automatically deemed down if the quarterback has failed to throw the football. These rules may further increase the safety of flag football by requiring fewer dedicated pass-rushing players and pass-blocking players and by making plays in which the quarterback is directly downed by a defensive player less common.

SUMMARY OF THE DISCLOSURE

As described above, flag football may provide a safer alternative to tackle football in which players are marked down in accordance with flags being pulled from their belts, rather than in accordance with being tackled. Furthermore, safety in flag football may be additionally increased by providing for (a) a time period following the snap before which defensive players may not rush the quarterback, and/or (b) a time period following the snap after which the quarterback may be automatically deemed down if he has not yet thrown the ball.

However, known systems and methods for enforcing the rules above (as well as play clock rules) in flag football have several flaws. First, even enforcement of conventional delay-of-game rules in flag football may be difficult due to a lack of stadium and electronic scoreboard facilities for many flag football games. Thus, delay-of-game rules may go unenforced or may be enforced improperly when officials or players attempt to enforce the rules on the basis of a stopwatch, wrist-watch, or the like. Furthermore, even if an official using a stopwatch accurately enforces a delay-of-game rule in a flag football game without a scoreboard or stadium-integrated play clock, players may still be disadvantaged by not being able to see for themselves the amount of time left on the play clock. Thus, improper or non-optimal enforcement and strategic influence on the game due to lack of play clock visibility may negatively affect flag football games.

Furthermore, enforcement of one or more of the rules explained above regarding timing restrictions for rushing the quarterback may, in accordance with known techniques, be even more inaccurate and unsatisfactory. For example, when rules dictate that defensive players may not rush the quarterback for a period of time following the snap, an official may have to time this period (e.g., using a stopwatch) and then signal the expiration of the period to defensive players; this may distract the official from observing the game and may be prone to error by the official. Additionally, when rules dictate that the quarterback is considered down after a certain period of time following the snap, an official may have to time this period (e.g., using a stopwatch); this may distract the official from observing the game, may be prone to error by the official, and may create a competitive disadvantage due to the quarterback not being able to see precisely how much time is left before the period of time expires. In games in which both of the above rules are enforced, the task for an official timing a game clock, the pass-rush time period, and the quarterback-throw time period all on every play may be overwhelming. Error may be increased or additional, dedicated officials may be required simply to time these periods.

Accordingly, there is a need for improved systems, methods, and techniques for timing in flag football and for signaling the expiration of various distinct time periods in flag football. Provided herein are electronic down-marker systems with integrated timers and displays configured to display a play clock for timing delay-of-game rules, to display a "go clock" for timing rules about rushing the quarterback, and to display a "throw clock" for timing rules about the quarterback throwing the ball within a certain time period. As explained herein, the system may have one or more displays configured to display one or more of the clocks described above, and may be configured to accept user inputs (e.g., to start or stop one of the clocks) via one or more input devices. In some embodiments, an electronic down-marker may be configured to electronically (e.g., wirelessly) communicate with one or more remote computing devices, such as a portable electronic device held by an official, another electronic down-marker, a football with one or more integrated processors configured to transmit information about the position of the football, and/or one or more flag football flags or flag football belts having one or more integrated processors configured to transmit information about the position of the belt/flag and/or a connection state of the belt/flag. Wireless electronic communication with other electronic devices may in some embodiments enable the electronic down-marker to automatically start and/or stop one or more of a play clock, go-clock, or throw-clock without explicit user instruction, which may therefore increase accuracy of timing and free game officials to observe play rather than manually operate one or more timers.

In some embodiments, an electronic sideline marker for use in football is provided, the marker comprising: a first display configured to display an indication of a down; a second display configured to display one or more timers; one or more processors; and memory storing instructions executable by the one or more processors to cause: displaying, on the second display, a first timer; and in accordance with detecting a first input, ceasing to display the first timer and displaying a second timer.

In some embodiments of the marker, the first timer counts down from a predetermined number of seconds and is associated with a delay-of-game rule.

In some embodiments of the marker, the second timer counts up from zero seconds and is associated with one or more of a go-clock rule and a throw-clock rule.

In some embodiments of the marker, detecting the first input comprises detecting a user pressing a button.

In some embodiments of the marker, detecting the first input comprises detecting a signal received from a remote electronic device comprising an instruction to cease to display the first timer and to display the second timer.

In some embodiments of the marker, the remote electronic device is a portable electronic device carried by a user and the signal is transmitted from the remote electronic device in response to receiving a second input from the user.

In some embodiments of the marker, the remote electronic device is a second electronic sideline marker.

In some embodiments of the marker, the instructions are further executable by the one or more processors to cause, in response to the first timer expiring, outputting a first indication that the first timer has expired.

In some embodiments of the marker, outputting the first indication comprises illuminating a first indicator light on the marker.

In some embodiments of the marker, outputting the first indication comprises outputting a first audible indication via a speaker on the marker.

In some embodiments of the marker, the instructions are further executable by the one or more processors to cause, in response to the second timer exceeding a first threshold, outputting a second indication that the second timer has exceeded the first threshold.

In some embodiments of the marker, outputting the second indication comprises illuminating a second indicator light on the marker.

In some embodiments of the marker, outputting the second indication comprises outputting a second audible indication via a speaker on the marker.

In some embodiments of the marker, the instructions are further executable by the one or more processors to cause, in response to the second timer exceeding a second threshold greater than the first threshold, outputting a third indication that the second timer has exceeded the second threshold.

In some embodiments of the marker, outputting the third indication comprises illuminating a third indicator light on the marker.

In some embodiments of the marker, outputting the third indication comprises outputting a third audible indication via a speaker on the marker.

In some embodiments of the marker, the instructions are further executable by the one or more processors to cause, in response to detecting a third input, resetting one or more timers of the marker.

In some embodiments of the marker, detecting the third input comprises detecting a user pressing a button.

In some embodiments of the marker, detecting the third input comprises detecting a signal received from a remote electronic device comprising an instruction to reset one or more timers of the marker.

In some embodiments of the marker, the remote electronic device is an electronic flag football connector configured to detect when a flag has been disconnected from a player, and wherein the signal is transmitted from the flag football connector in response to detecting that the flag has been disconnected from the player.

In some embodiments, a method for displaying timers for use in football is provided, the method comprising: at an electronic sideline marker comprising a first display configured to display an indication of a down, a second display configured to display one or more timers, and one or more processors: displaying, on the second display, a first timer; and in accordance with detecting a first input, ceasing to display the first timer and displaying a second timer.

In some embodiments, a non-transitory computer-readable medium comprising instructions executable by one or more processors is provided, the instructions configured to cause the one or more processors to: at an electronic sideline marker comprising a first display configured to display an indication of a down, a second display configured to display one or more timers, and one or more processors: display, on the second display, a first timer; and in accordance with detecting a first input, cease to display the first timer and display a second timer.

In some embodiments, an electronic flag football equipment set is provided, the set comprising: an electronic sideline marker comprising: a display configured to display one or more timers; a first wireless communication device; an electronic flag football connector for connecting a flag to a wearable item, comprising: a first sensor configured to detect when the flag has been disconnected from the wearable item; a second wireless communication device; one or more processors; and memory storing instructions executable by the one or more processors to cause: in response to detecting, by the first sensor, that the flag has been disconnected from the wearable item, transmitting a signal from the first wireless communication device; and in response to receiving the signal at the second wireless communication device, outputting an indication that the flag has been disconnected from the wearable item.

In some embodiments of the set, the instructions are further executable by the one or more processors to cause, in response to receiving the signal at the second wireless communication device, pausing or resetting one of the one or more timers.

In some embodiments of the set: the electronic flag football connector comprises a second sensor configured to determine a location of the connector; and the instructions are further executable by the one or more processors to cause: in response to detecting, by the first sensor, that the flag has been disconnected from the wearable item, determining a location, by the second sensor, of the flag at the time of the detachment; transmitting a signal from the first wireless communication device to the second wireless communication device indicating the determined location; and outputting, by an output device of the marker, an indication of the determined location.

In some embodiments, any of the limitations discussed above may apply alone and/or in combination with any one or more of the other limitations discussed above, with respect to the marker, method, computer-readable storage medium, and/or the set, as would be appreciated in light of the present disclosure.

BRIEF DESCRIPTION OF THE DRAWINGS

The foregoing summary, as well as the following detailed description of embodiments, is better understood when read in conjunction with the appended drawings. For the purpose of illustrating the present disclosure, the drawings show exemplary embodiments of the disclosure; the disclosure, however, is not limited to the specific methods and instrumentalities disclosed. In the drawings.

DETAILED DESCRIPTION

Described herein are flag football down markers, associated flag football equipment, and methods for use thereof.

Figure 1:
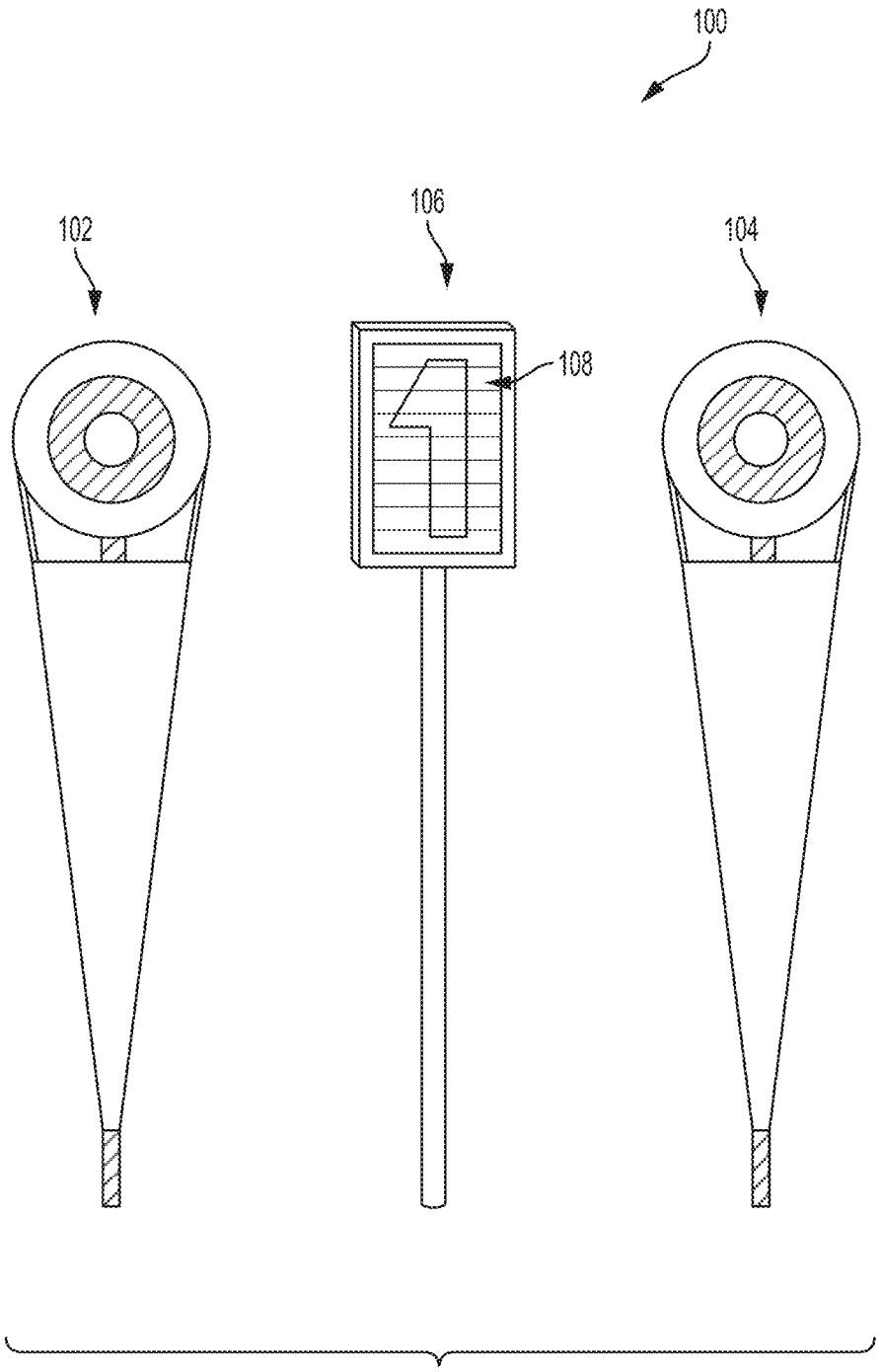
FIG. 1 shows a football sideline marker set, in accordance with some embodiments.

FIG. 1 shows football sideline marker set 100, in accordance with some embodiments. As shown, set 100 may include markers 102, 104, and 106. In some embodiments, markers 102 and 104 may be used to mark the yard-line at the current set of downs began and to mark the line-to-gain for a first down, respectively. Markers 102 and 104 may be tethered to one another by a chain that is ten yards in length. In some embodiments, marker 106 may be used to mark the line of scrimmage for the current play. Each of the markers may comprise a main body at the top configured to be generally broad and flat and easily visible from the field of play; the main body of a marker may be mounted atop a pole or mast such that the pole may be rested on the ground and held upright by an operator and the main body may be easily visible from the field of play, including by being able to be seen over the heads of players and officials and other personnel on the field and sideline.

In some embodiments, marker 108, which may be used to mark the current line of scrimmage, has display 108 disposed on its main body, such that display 108 may be visible from the field by players and officials. Display 108 may be used to display the current down (e.g., first down, second down, third down, or fourth down). In some embodiments, display 108 may be used to display other information.

In some embodiments, display 108 may comprise a plurality of slidable slats that may be repositioned to cause the device to display a different indicia (e.g., one indicia corresponding to each of the four downs). In some such embodiments, the slats may be controllable by one or more manual input decides, such as buttons, knobs, or sliding handles. In some embodiments, display 108 may be a digital display, such as a display comprising one or more LEDs or other illumination elements arranged to be able to display numbers or letters, a high-resolution LCD display, a high-resolution LED display, or any other suitable electronically controllable digital display. In some such embodiments, the indicia or other information displayed on display 108 may be controllable by one or more local or remote input devices, such as electronic buttons keys, keyboards, mouses, joysticks, touch-screen controls, voice-controls, or the like.

Figure 2:
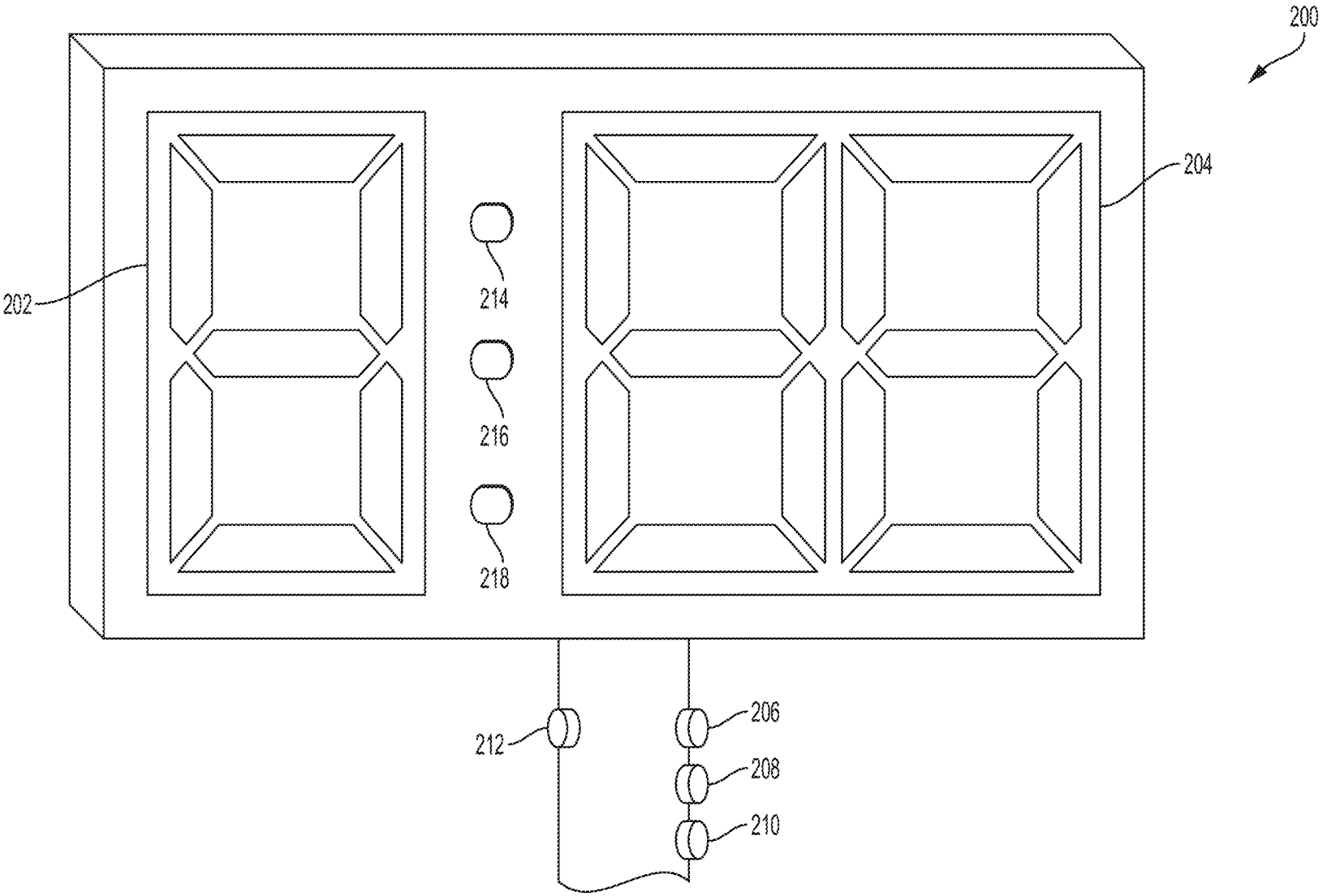
FIG. 2 shows a football sideline marker, in accordance with some embodiments.

FIG. 2 shows football sideline marker 200, in accordance with some embodiments. In some embodiments, marker 200 may be a marker used to indicate a current line of scrimmage in a football game, and may be a part of a sideline marker set such as set 100 described above with reference to FIG. 1. In some embodiments, marker 200 may share any one or more characteristics in common with marker 106 described above with reference to FIG. 1; in some embodiments, a sideline marker such as marker 102 or 104 may be modified to have any one or more of the features of marker 200 described herein.

As shown in FIG. 2, marker 200 may be a sideline marker having two displays, one or more visual indicators such as lights 214-218, and one or more input mechanisms such as buttons 206-212. In some embodiments such as those described herein, the two displays may be used to simultaneously display down information (e.g., what down is the current play?) and timer information (e.g., game clock, play clock, go clock, throw clock, etc.). In some embodiments, a first display may display down information while a second display simultaneously displays clock information. Expiration of one or more timers may, in some embodiments, cause marker 200 to output a corresponding indication, such as an audio indication outputted by a speaker of the marker and/or a visual indication outputted by one or more of lights 214-216. In some embodiments, one or more controls or input devices may be included on marker 200 (or may be remotely disposed to electronically communicate with marker 200) to control one or more of the displays. For example, a user may be able to use one or more of buttons 206-208 to cycle through down indicia displayed on one of the displays, to control timer indicia displayed on the other one of the displays, or to otherwise control or modify displayed and/or outputted information.

In the example of FIG. 2, marker 200 includes displays 202 and 204. In some embodiments, both display 202 and display 204 may be disposed on the same face of the marker, while in some embodiments they may be disposed on different faces of the marker (e.g., when the marker body is roughly cubic, having broad faces disposed at right angles to one another, as opposed to having only broad front and back faces with narrow edges as shown in the example of FIG. 2). In some embodiments, both displays 202 and 204 may be disposed on marker 200 such that the displays are easily and clearly visible from the field of play when marker 200 is held upright on the sideline, with the main body housing the displays sitting atop a supporting mast or pole.

In some embodiments, display 202 may be configured to display indicia relating to the current down of the game, while in some embodiments it may be configured to display additional or different information. In some embodiments, display 202 may share some or all characteristics in common with display 108 described above with reference to FIG. 1. For example, display 202 may comprise a plurality of slidable slats and/or electronic display components. In the example of FIG. 2, display 202 is shown as an electronic display configured to display a single numeric digit (e.g., 0-9). In this way, display 202 may be configured to display an indicia of a down (e.g., "1" for first down, "2" for second down, "3" for third down, and "4" for fourth down).

In some embodiments, display 204 may be configured to display indicia relating to one or more timers, while in some embodiments it may be configured to display additional or different information. In some embodiments, display 204 may share some or all characteristics in common with display 108 described above with reference to FIG. 1. For example, display 204 may in some embodiments be an electronic display.

In the example of FIG. 2, display 202 is shown as an electronic display configured to display two numeric digits (e.g., two digits 0-9). In this way, display 202 may be configured to display a timer showing a time with two digits, such as a count-down timer or a count-up timer displaying 99 seconds or fewer. In some embodiments, timer 204 may be configured to display fewer than two numeric digits or more than two numeric digits, or it may be configured to display letters and numbers or multiple timers at the same time.

In some embodiments, the two-digit configuration of the exemplary display shown in FIG. 2 may allow display 204 to be configured to display timers for one or more of a play clock, go clock, and/or throw clock. For example, in games in which a 35-second play clock is used, a play clock timer beginning at 35 seconds and counting downward toward zero may be displayed on display 202.

In some embodiments, if the play clock timer reaches zero, then an indication may be output from marker 200; for example, an audio output may be emitted from a speaker of marker 200 or a visual indication may be generated by marker 200, such as by illuminating one or more indicator lights such as indicator light 214. In some embodiments, indicator light 214 may be a light configured to indicate a play clock violation; in some embodiments, visual indicia such as text may be located proximate to light 214 to associate the light with a play clock violation. In some embodiments, light 214 may be red in color. In some embodiments, light 214 may have any color or shape, and may be accompanied by one or more lights serving the same or similar function; for example, in some embodiments, light 214 may illuminate a rim of a face of marker 200 or may illuminate a rim of display 204.

In some embodiments, following display of a play clock timer by display 204 before the snap of the ball, a go-clock timer may be displayed by display 204 after the snap of the ball. For example, display 204 may cease to display the play clock timer and may display a go-clock timer in its place. In some embodiments, while the play clock timer may have counted down from a predetermined number of seconds toward zero, the go-clock may instead count upwards from zero toward a predetermined number of seconds (e.g., defensive players may be allowed to rush the quarterback after two seconds, three seconds, or any other predetermined amount of time).

In some embodiments, if the go-clock timer reaches the predetermined maximum amount of time for the go-clock, then an indication may be output from marker 200; for example, an audio output may be emitted from a speaker of marker 200 or a visual indication may be generated by marker 200, such as by illuminating one or more indicator lights such as indicator light 216. In some embodiments, indicator light 216 may be a light configured to indicate that a go-clock has reached a predetermined amount of time and that defensive players are permitted to rush the quarterback; in some embodiments, visual indicia such as text may be located proximate to light 216 to associate the light with a go-clock. In some embodiments, light 214 may be green in color. In some embodiments, light 216 may have any color or shape, and may be accompanied by one or more lights serving the same or similar function; for example, in some embodiments, light 216 may illuminate a rim of a face of marker 200 or may illuminate a rim of display 204.

In some embodiments, display 204 may be configured to display a throw-clock timer. In some embodiments, a go-clock and a throw-clock may be timed by the same timer for at least part of the duration of the throw-clock. That is, since a throw-clock is necessarily longer than a go-clock, and since both clocks may begin timing from the moment of the snap of the football, timing the first portion of the throw-clock (the portion that overlaps with timing the go-clock) may be done by the same timer. Thus, as a go-clock counts up from zero seconds toward a predetermined time (e.g., two seconds), it may also serve to time the first portion of the throw clock. Thus, once the displayed timer reaches the predetermined go-clock time and defensive players are permitted to rush the quarterback, then the timer may continue (e.g., without interruption) to count upwards, and the timer may be understood from that point forward to pertain to the throw-clock, rather than to the go-clock. For example, once the maximum go-clock time has been passed and/or the go-clock indicator has been output, then the timer may be understood to pertain to the throw clock. Thus, the throw-clock time may be displayed by display 204, in some embodiments, in the same manner as the go-clock timer.

In some embodiments, if the throw-clock timer reaches the predetermined maximum amount of time for the throw-clock, then an indication may be output from marker 200; for example, an audio output may be emitted from a speaker of marker 200 or a visual indication may be generated by marker 200, such as by illuminating one or more indicator lights such as indicator light 218. In some embodiments, indicator light 218 may be a light configured to indicate a that a throw-clock has reached a predetermined amount of time and that defensive players are permitted to rush the quarterback; in some embodiments, visual indicia such as text may be located proximate to light 218 to associate the light with a go-clock. In some embodiments, light 214 may be red in color. In some embodiments, light 218 may have any color or shape, and may be accompanied by one or more lights serving the same or similar function; for example, in some embodiments, light 218 may illuminate a rim of a face of marker 200 or may illuminate a rim of display 204.

While the above discussion has contemplated embodiments in which a go-clock and a throw-clock are both timed in accordance with the same timer at once, in some other embodiments a go-clock and throw-clock may be displayed separately in time and/or separately in space. In some embodiments, a go-clock timer and a throw clock timer may be simultaneously displayed on different displays. In some embodiments, a go-clock timer and a throw-clock timer may be displayed one after another on the same display; for example, display of the go-clock may be replaced by display of the throw-clock, which may begin counting upward from zero or downward from any predetermined amount only after the go-clock expires (e.g., reaches zero when counting downward or reaches a predetermined maximum amount of time when counting upward).

In some embodiments, marker 200 may comprise one or more input devices configured to control display of information on display 202. For example, if display 202 comprises movable slats, then marker 200 may comprise one or more handles configured to move the slats to cause different information to be displayed. In some embodiments, when display 202 is a digital electronic display, marker 200 may comprise one or more input mechanisms such as button 212 configured to control display of information on display 202. In some embodiments, pressing button 212 may cause display 202 to cycle through display of different down indicia (e.g., "1" through "4").

In some embodiments, marker 200 may comprise one or more input devices configured to control display of information on display 204. For example, if display 204 is a digital electronic display, marker 200 may comprise one or more input mechanisms such as buttons 206, 208, and 210 configured to control display of information on display 202.

In some embodiments, pressing button 206 may cause one or more timers displayed on display 204 to reset. For example, pressing button 204 may cause a current timer to be cleared and for a new play clock timer to be displayed starting at the full amount of time for the play clock (e.g., 35 seconds).

In some embodiments, pressing button 208 may cause one or more timers displayed on display 204 to alternately start or pause. For example, pressing button 204 may start/pause a play clock timer, go clock timer, and/or throw-clock timer displayed on display 204.

In some embodiments, pressing button 210 may cause marker 200 to change modes from one timer to another timer. For example, a user may press button 210 when the football is snapped to cause marker 200 to change from a play clock mode to a go-clock/throw-clock mode. In some embodiments, pressing button 210 may cause a play clock timer to be paused and/or to cease to be displayed, and may simultaneously cause a go-clock and/or throw-clock to start to be displayed and or to start/un-pause. In embodiments in which marker 200 displays a play clock timer and a go-/throw-clock timer using the same portion of the same display, pressing button 210 may cause the play clock timer to cease to be displayed and may cause the go-/throw-clock timer to be displayed in its place. In some embodiments, a go-/throw-clock timer may be automatically displayed and started in response to detecting button 210 being pressed.

In some embodiments, marker 200 may include one or more additional input mechanisms, or may be in electronic communication with one or more additional remote input mechanisms, configured to control the display of information on display 202 and/or display 204.

Figure 3:
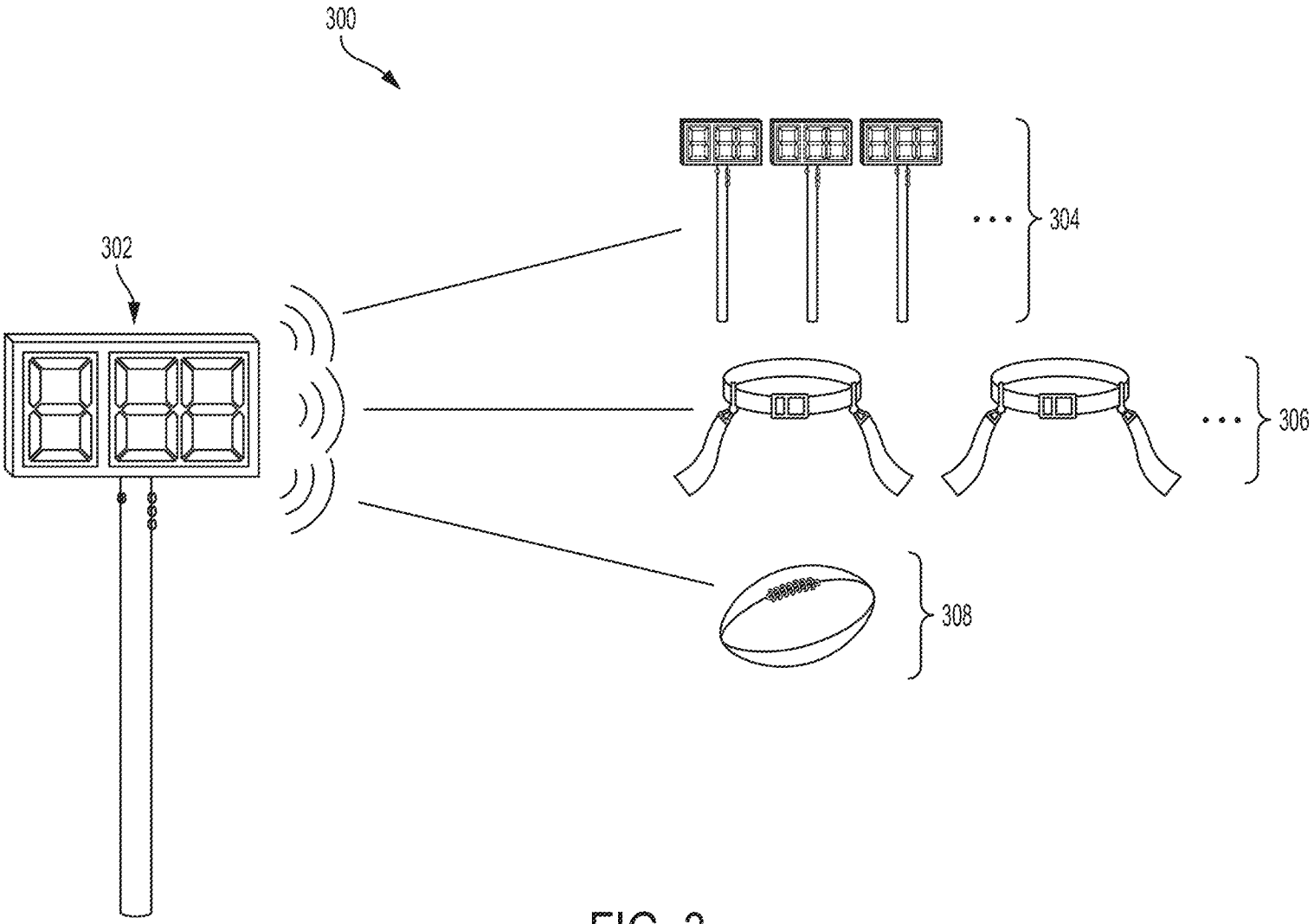
FIG. 3 shows a football equipment set, in accordance with some embodiments.

FIG. 3 shows flag football equipment set 300, in accordance with some embodiments. As shown in FIG. 3, set 300 may comprise sideline marker 302, additional sideline markers 304, flag belt set 306, and football 308. In some embodiments, each components of set 300 may contain one or more electronic (e.g., wireless) communication devices such that the components may communicate data by sending and receiving electronic signals to and from one another.

In some embodiments, marker 302 may share any one or more characteristics in common with marker 200 discussed above with respect to FIG. 2. Marker 302 may comprise one or more processors and one or more electronic communication devices for wired and/or wireless communication with sideline markers 304, flag belt set 306, and/or football 308. In some embodiments, marker 302 may be configured to send data regarding an indication of a down and/or a state of one or more timers (e.g., a game clock, play clock, go-clock, and/or throw clock) to one or more of the other components of set 300.

In some embodiments, additional sideline markers 304 may comprise one or more markers that each may share one or more characteristics in common with marker 302. In some embodiments, markers 304 may be individually operable by a user and/or configured to send information regarding downs and/or timers to other components of set 300. In some embodiments, markers 304 may be passive, or may be configured to be able to be operated in a passive mode. In a passive mode, markers 304 may be configured to receive data from other components of set 300, including marker 302, and/or from other sources, but not to send data. In a passive mode, markers 304 may be configured to "mirror" marker 302 by displaying the same down and/or timer information as marker 302. In some embodiments, markers 304 may be used in the same game in addition to marker 302, such as by being used at another location on the sideline, in order to increase visibility of down and/or clock information for players and officials.

In some embodiments, flag belt set 306 may comprise one or more flag football belts and associated flags and/or connectors configured to electronically communicate with one or more other components of set 300. In some embodiments, each belt, flag, or connector may comprise one or more sensors such as a connection sensor, position sensor, accelerometer, time sensor, and/or other type of sensor configured to collect data about a state of the device for transmission to another component of set 300. In some embodiments, connectors configured to attach a flag to a belt (and/or another wearable item configured for use in flag football games) may be configured to detect when the flag has been detached from the belt and to generate a signal regarding a location and a time at which the detachment occurred. In some embodiments, information regarding the time and/or location at which the detachment occurred may be sent via the signal to one or more other components of set 300. In some embodiments, the information regarding time and/or location of detachment may be used in controlling one or more timers for the game and/or making one or more determinations regarding ball placement and/or scoring of the game (e.g., to determine a yard-line or location of the ball or of a player when the detachment occurred). In some embodiments, flag belt set 306 may include flags, belts, wearable garments, and/or flag connectors having one or more characteristics in common with the flag football equipment disclosed in U.S. provisional application No. 62/561,865, filed Sep. 22, 2017, which is hereby incorporated by reference in its entirety.

In some embodiments, football 308 may be a football configured to electronically communicate with one or more other components of set 300. In some embodiments, football 308 may comprise one or more sensors such as a position sensor, accelerometer, time sensor, and/or other type of sensor configured to collect data about a state of the ball for transmission to another component of set 300. In some embodiments, football 308 may be configured to determine information regarding the position of the football on the field (e.g., a yard-line of the football at a particular moment) or motion of the football (e.g., whether the ball has been snapped) and to transmit that information via a signal to one or more other components of set 300. In some embodiments, the transmitted information may be used in controlling one or more timers for the game and/or making one or more determinations regarding ball placement and/or scoring of the game (e.g., to determine a yard-line or location of the ball, to determine whether the ball was snapped before the play clock expired, etc.).

In some embodiments, including those in which a flag belt set and/or football are configured to communicate with a marker such as marker 302, marker 302 may be configured to display one or more indications relating to any or all information received from flag belt sets, footballs, and/or other remote electronic devices. For example, marker 302 may be configured to output an indication of a yard-line at which a football was located when a flag was detached from a belt, or a yard-line at which a flag itself was located when the flag was detached from the belt. Alternately or additionally, marker 302 may be configured to output an indication of a yard-line of a football when the football is determined to have stopped moving, or when a user of the system generates an input, such as by pressing a button, to query the location of the football. In this way, marker 302 may be used to determine where a football should be spotted in the game, and may output information regarding where the football should be spotted (such as by displaying the information) in such a way that players, officials, and coaches may all easily receive the outputted information.

While some embodiments set out in this disclosure contemplate a marker (e.g., marker 200, marker 302) comprising one or more processors and/or one or more electronic communication devices for wired and/or wireless communication integrated into the marker itself, as well as markers comprising one or more control devices integrated into the marker itself, in some embodiments one or more of the control devices, communication devices, and/or processors used to control a marker may be provided as part of an external control device. That is, in some embodiments, a marker may be configured to be physically and/or electronically coupled to one or more external devices for control of the marker. For example, in some embodiments, a marker may be configured to physically couple to a remote and/or external control device which may be configured to control any one or more of the functions of the marker as set out herein, such as displayed information, generated outputs, and/or inter-marker communication. In some embodiments, a marker may be configured to receive electronic signals via wired and/or wireless communication channels, the signals comprising commands from an external control device directing the functionality of one or more markers.

In some embodiments, an external control device may comprise one or more processors, one or more wireless and/or wired electronic communication devices, may comprise one or more input devices (e.g., buttons, keys, touch-screen devices, mouses, etc.), and may comprise one or more displays. In some embodiments, an external control device may execute one or more of the methods described herein for control of one or more markers, and/or may store instructions (e.g., computer programs) for control of one or more markers as described herein. In some embodiments, an external control device may be a personal computer, a laptop, a tablet, a dedicated electronic control device specifically configured to control markers, a portable electronic device, and/or a smart-phone.

In some embodiments, an external control device may couple to the marker via one or more wireless electronic communication connections, such as Wi-Fi, Bluetooth, or any other suitable wireless communication protocol. In some embodiments, an external control device may couple to the marker via one or more physical (e.g., wired) electronic communication connections, such as by USB connection or any other suitable physical electronic connection. In some embodiments, a marker may be configured to physically receive all or part of an external control device such that the external control device is docked in a fixed physical position on, in, or partially in the marker.

In some embodiments, an external control device may comprise a radio-frequency enabled remote device configured to couple to one or more markers by wired or wireless communication, and/or to couple to one or more mobile devices (e.g., smartphone's of users) by wired or wireless communication. In some embodiments, the radio-frequency enabled remote device may be configured to wirelessly connect to and/or physically dock with one or more markers.

In some embodiments, a user may control a radio-frequency enabled remote device through a wired or wireless connection with their mobile electronic device, such as by entering commands into their smart phone which are passed to the radio-frequency enabled remote device and then passed from the radio-frequency enabled remote device to one or more markers. In some embodiments, a radio-frequency enabled remote device may be configured to have superior effective wireless communication range compared to Bluetooth communication or other wireless communication protocols, and may therefore improve latency issues when used in a system of markers.

In some embodiments, a user may control a radio-frequency enabled remote device through direct manipulation of the radio-frequency enabled remote device, such as by entering commands on one or more input devices (e.g., buttons, touch-sensitive surfaces, etc.) of the radio-frequency enabled remote device.

In some embodiments, a user may control one or more markers using a radio-frequency enabled remote device and/or a mobile electronic device such as a smartphone or tablet. In some embodiments, a radio-frequency enabled remote device may be useful for controlling in-game functionality and use of a marker with superior wireless communication capabilities as compared to a Bluetooth enabled personal mobile electronic device, while a Bluetooth enabled personal mobile electronic device may offer additional control functionality beyond that offered by the radio-frequency enabled remote device. For example, a user may, in some embodiments, use a Bluetooth enabled personal mobile electronic device to change marker setting and/or push functional updates to markers, which may not be possible using a radio-frequency enabled remote device alone.

Figure 4:
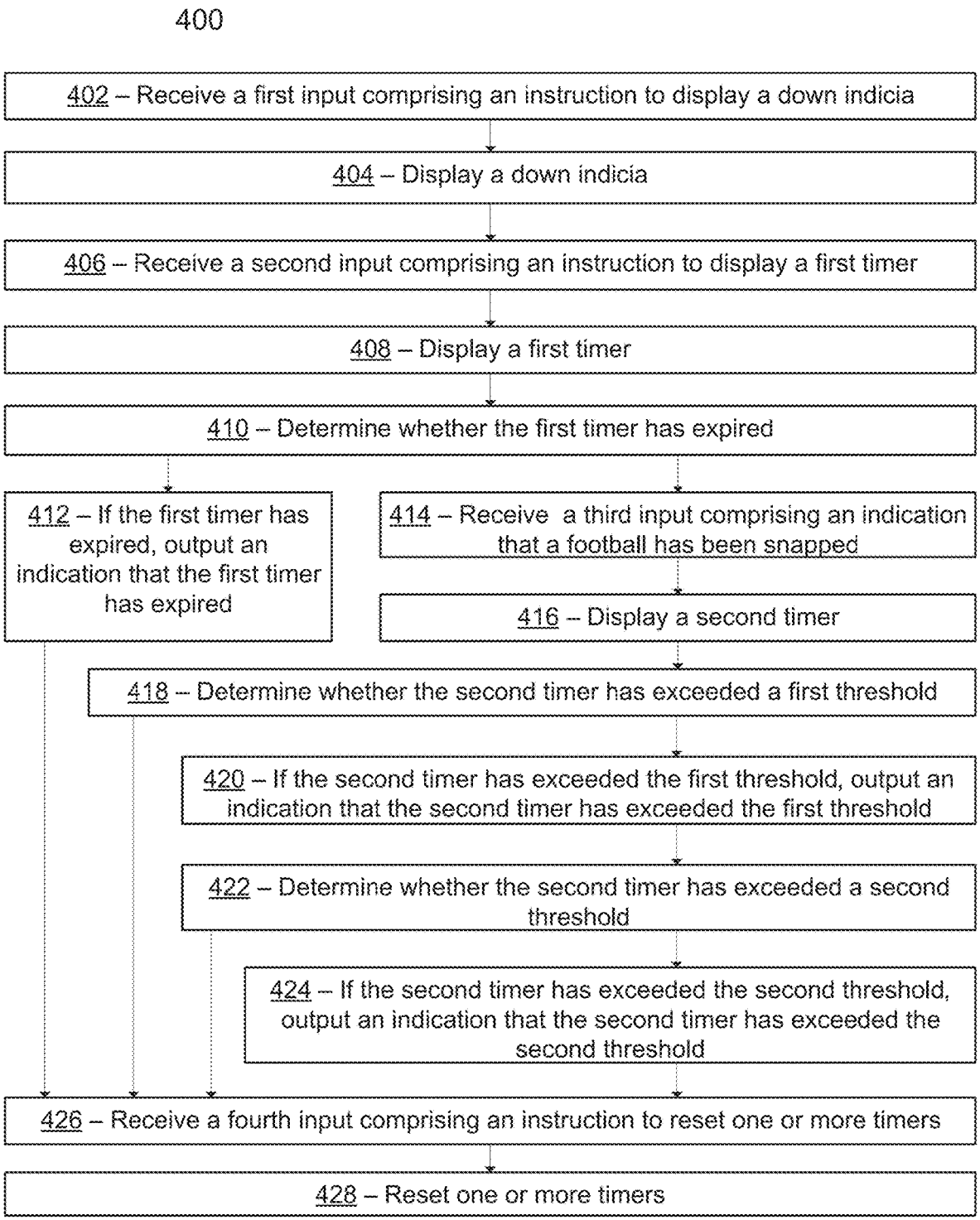
FIG. 4 shows a method for operating a multi-timer electronic football sideline marker, in accordance with some embodiments.

FIG. 4 shows a flow diagram of method 400 for operating a multi-timer electronic football sideline marker, in accordance with some embodiments. In some embodiments, method 400 is a method for displaying down and timer information for a flag football game including a play clock, a go-clock, and a throw-clock. In some embodiments, method 400 is performed by an electronic sideline marker having one or more processors, one or more displays, and memory storing instructions configured to be executed by the one or more processors to perform the method. In some embodiments, method 400 may be performed by a marker, such as markers 200 or 302 as described above.

At block 402, in some embodiments, the marker may receive a first input comprising an instruction to display a down indicia. In some embodiments, the first input may be any physical or mechanical input delivered to the marker, or it may be any electronic input or signal delivered to or caused to be generated by the marker. For example, a user may actuate one or more electronic buttons to generate the first input, or an electronic communications interface (e.g., a network communications interface) of the marker may receive one or more signals comprising data representing the first input. In the example of FIG. 2, a user may press button 212 to cycle through different indicia of downs (e.g., "1," "2," "3," and "4"). In some embodiments, the first input may be received from a remote electronic device communicating with the marker, including but not limited to any one or more of the components of set 300.

At block 404, in some embodiments, in response to receiving the first input, the marker may display a down indicia. The down indicia may be displayed by one or more display devices of the marker. In some embodiments, the down indicia may be caused to be displayed in accordance with one or more properties of the received first input; for example, the input may designate which down indicia should be displayed, and/or a manner in which it should be displayed. In the example of FIG. 2, the down indicia may be displayed by electronic display 202 in accordance with the user pressing button 212.

At block 406, in some embodiments, the marker may receive a second input comprising an instruction to display a first timer. In some embodiments, the second input may share any one or more characteristics, including being received in any one or more same or similar manners, as the first input described above. In some embodiments, the first timer may be a play clock timer, and the second input may thereby comprise an instruction to display a play clock timer. In the example of FIG. 2, a user may press button 206 to activate, turn on, wake, and/or reset a play clock timer of marker 200 for display on display 204.

At block 408, in some embodiments, in response to receiving the second input, the marker may display a first timer, which may in some embodiments be a play clock timer. The play clock timer may be displayed by one or more display devices of the marker. In some embodiments, the play clock timer may be caused to be displayed in accordance with one or more properties of the received first input; for example, the input may cause the device to restart the timer, pause the timer, start (e.g., unpause) the timer, set a starting time for the timer, and/or designate a manner in which the timer should be displayed. In the example of FIG. 2, the play clock timer may be displayed by electronic display 204 in accordance with the user pressing button 206 to reset the timer.

In some embodiments, the marker may receive a separate input causing the first timer to start or to pause. For example, a user of marker 200 in FIG. 2 may press button 208 to start the timer in the event that the timer is paused, or may press button 208 to pause the timer in the event that the timer is running. In some embodiments, resetting the timer may cause it to automatically start, while in some embodiments an explicit and separate input may be required.

At block 410, in some embodiments, the marker may determine whether the first timer has expired. In some embodiments, the marker may periodically query the first timer to determine whether it has expired. In some embodiments, expiration of the first timer may comprise the timer reaching zero, such as when the timer is counting down toward zero from a predetermined non-zero time. In some embodiments, expiration of the first timer may comprise the timer reaching a predetermined non-zero time, such as when the timer is counting up from zero.

If the first timer has expired, then method 400 may proceed to block 412. If the first timer has not yet expired (and, in some embodiments, if one or more other conditions occurs before expiration of the timer), then method 400 may proceed to block 414.

Turning first to block 412, in some embodiments, if the marker determines at block 410 that the first timer has expired, the marker may output an indication that the first timer has expired. In some embodiments, the indication may be an audio indication, a visual indication, a haptic indication (e.g., vibration), or any combination thereof. In some embodiments, an audio indication may comprise emitting a tone or other audible indication (e.g., a recording or rendering of spoken language) from one or more speakers of the marker. In some embodiments, a visual indication may comprise illuminating one or more lights or displaying one or more visual indicia on a display. In the example of FIG. 2, outputting the indication that the first timer has expired may comprise displaying "00" on display 204 and/or illuminating light 214. In some embodiments, the indication may be emitted for a predetermined amount of time, or indefinitely until a user resets the marker (e.g., by pressing button 206 to reset the timers). Following block 412, method 400 may proceed to block 426, discussed in greater detail below.

Turning alternately to block 414, in some embodiments, the marker may receive a third input comprising an indication that a football has been snapped. In some embodiments, the third input may be received before the marker has determined that the first timer has expired.

In some embodiments, the third input may share any one or more characteristics, including being received in any one or more same or similar manners, as the first and/or second inputs described above. In some embodiments, the third input may comprise detecting that a user has pressed a button or manually entered the input in another manner, such as by pressing button 208 in the example of FIG. 2. For example, a user of the marker who is holding the marker upright on the sideline at the line of scrimmage may watch the football and wait until it is snapped; upon seeing that the football is snapped, the user may press button 210 to send a signal to marker 200 that the ball has been snapped.

In some embodiments, the third input may be received via an electronic signal from one or more remote electronic devices, including from any one or more of the components of set 300 in FIG. 3. In some embodiments, the third input may be received via a wireless electronic signal transmitted from an electronic football being used in the football game, such as football 308 of set 300. For example, an electronic football may determine that it has been snapped, such as by a position sensor and/or accelerometer, and may generate and wirelessly transmit an electronic signal indicating as much to the marker. The marker may receive the signal and may extract from it the third input comprising the indication that the football has been snapped. In this way, delay and error potentially caused by relying on a human operator to indicate the snap of the football (e.g., by pressing a button) may be avoided.

At block 416, in some embodiments, in response to receiving the third input, the marker may display a second timer. In some embodiments, the second timer may be a go-clock timer and/or a throw-clock timer, as discussed above, or may be any other timer configured to be displayed following the snap of the football. In some embodiments, the second timer may count down from a predetermined amount of time toward zero, while in some embodiments the second timer may count up from zero.

In some embodiments, the second timer may be caused to be displayed in accordance with one or more properties of the received first input; for example, the input may cause the device to restart the second timer, pause second the timer, start (e.g., unpause) the second timer, set a starting time for the second timer, and/or designate a manner in which the second timer should be displayed. In some embodiments, for example where the second timer is a go-clock timer and/or a throw-clock timer, marker may automatically display and start the second timer in response to receiving the input that the ball has been snapped.

The second timer may be displayed by one or more display devices of the marker. In some embodiments, displaying the second timer may comprise ceasing to display the first timer, such as when the second timer is displayed by all or part of the same portion of a same display used to display the first timer. In the example of FIG. 2, the second timer may be displayed by electronic display 204 in accordance with the user pressing button 210 to switch marker 200 from play clock mode to go-/throw-clock mode.

At block 418, in some embodiments, the marker may determine whether the second timer has exceeded a first threshold. For example, when the second timer is a go-clock timer, this determination may comprise determining whether the go-clock time-period has expired and whether defensive players are thereby permitted to rush the quarterback. In embodiments in which the second timer counts up from zero, this determination may comprise determining whether the timer has reached or exceeded a predetermined number of seconds. In alternate embodiments, such as when the go-clock timer counts down toward zero from a predetermined number of seconds, the marker may instead determine whether the second timer has expired by reaching zero. In some embodiments, the marker may periodically query the second timer to determine whether it has exceeded the first threshold (or, if counting downward, whether it has reached zero).

If the second timer has exceeded the first threshold, then method 400 may proceed to block 420. If the first timer has not yet exceeded the first threshold (and, in some embodiments, if one or more other conditions occurs before the second timer exceeds the first threshold), then method 400 may proceed to block 426, which is discussed further below.

Turning now to block 420, in some embodiments, if the marker determines at block 418 that the second timer has exceeded the first threshold, the marker may output an indication that the first threshold has been exceeded. In some embodiments in which the first timer is a go-clock timer, the outputted indication may be an indication that the go-clock has expired and that defensive players are permitted to rush the quarterback.

In some embodiments, the indication may be an audio indication, a visual indication, a haptic indication (e.g., vibration), or any combination thereof. In some embodiments, an audio indication may comprise emitting a tone or other audible indication (e.g., a recording or rendering of spoken language) from one or more speakers of the marker. In some embodiments, a visual indication may comprise illuminating one or more lights or displaying one or more visual indicia on a display. In the example of FIG. 2, outputting the indication that the first threshold has been exceeded may comprise displaying one or more indications on display 204 (e.g., by showing a number of seconds on the second timer greater than the first threshold) and/or illuminating light 216. In some embodiments, the indication may be emitted for a predetermined amount of time, or indefinitely until a user resets the marker (e.g., by pressing button 206 to reset the timers).

At block 422, in some embodiments, the marker may determine whether the second timer has exceeded a second threshold. In some embodiments, determining whether the second timer has exceeded a second threshold may be performed when the second timer serves both as a go-clock and as a throw-clock, and wherein the second timer continues to count upwards from zero after the first threshold has already been exceeded. Thus, after the go-clock has expired and players are permitted to rush the quarterback, the second timer displayed by the marker may continue to count upwards until a greater predetermined threshold time is reached and the throw-clock thereby expires.

Thus, for example, when the second timer is a throw-clock timer (potentially in addition to a go-clock timer), the determination made with regard to the second threshold may comprise determining whether the throw-clock time-period has expired and whether the quarterback should be ruled down if the quarterback has not yet thrown the football. In embodiments in which the second timer counts up from zero, this determination may comprise determining whether the timer has reached or exceeded a predetermined number of seconds (which may be greater than the predefined number of seconds corresponding to the first threshold discussed above). In alternate embodiments, such as when the throw-clock timer counts down toward zero from a predetermined number of seconds, the marker may instead determine whether the second timer has expired by reaching zero. In some embodiments, the marker may periodically query the second timer to determine whether it has exceeded the second threshold (or, if counting downward, whether it has reached zero).

If the second timer has exceeded the second threshold, then method 400 may proceed to block 424. If the first timer has not yet exceeded the first threshold (and, in some embodiments, if one or more other conditions occurs before the second timer exceeds the second threshold), then method 400 may proceed to block 426, which is discussed further below.

Turning now to block 424, in some embodiments, if the marker determines at block 422 that the second timer has exceeded the second threshold, the marker may output an indication that the second threshold has been exceeded. In some embodiments in which the first timer is a throw-clock timer, the outputted indication may be an indication that the throw-clock has expired and that the quarterback should be ruled down if the quarterback has not yet thrown the football.

In some embodiments, the indication may be an audio indication, a visual indication, a haptic indication (e.g., vibration), or any combination thereof. In some embodiments, an audio indication may comprise emitting a tone or other audible indication (e.g., a recording or rendering of spoken language) from one or more speakers of the marker. In some embodiments, a visual indication may comprise illuminating one or more lights or displaying one or more visual indicia on a display. In the example of FIG. 2, outputting the indication that the first threshold has been exceeded may comprise displaying one or more indications on display 204 (e.g., by showing a number of seconds on the second timer greater than the second threshold) and/or illuminating light 218. In some embodiments, the indication may be emitted for a predetermined amount of time, or indefinitely until a user resets the marker (e.g., by pressing button 206 to reset the timers).

In some alternate embodiments, rather than determining whether the second timer has exceeded a second threshold as in blocks 422 and 424, the marker may alternately determine whether a third timer has exceeded a second threshold. That is, in some embodiments, the third timer may be calculated, processed, displayed, and/or outputted independently of the second timer. In this way, in some embodiments, a third timer may represent a throw-clock independent of a second timer representing a go-clock.

Attention is now directed to block 426, which may follow from block 412, 418, 422, or 424. At block 426, in some embodiments, the marker may receive a fourth input comprising an instruction to reset one or more of the timers. In some embodiments, the fourth input may share any one or more characteristics, including being received in any one or more same or similar manners, as the first, second, and/or third inputs described above. In some embodiments, the fourth input may be entered by a user in accordance with the conclusion of a play in the game, in order to reset the play clock timer (and/or go-clock timer and throw-clock timer) for the next play. In the example of FIG. 2, a user may press button 206 to activate, turn on, wake, and/or reset a play clock timer of marker 200 for display on display 204 and for use during a subsequent play.

At block 428, in some embodiments, in response to receiving the fourth input, the marker may reset one or more of the timers. In some embodiments, resetting one or more of the timers may cause the one or more timers to be reset to their initial states; for example, timers may be set to zero for timers that count upward, may be set to a predetermined starting number of seconds for timers that count downward, and may be set to a paused or running state in accordance with predetermined settings of the marker. In some embodiments, in accordance with the marker being reset, one or more of a play clock timer, go-clock timer, and throw-clock timer may be reset to their initial state for use during an upcoming play. In the embodiment of FIG. 2, a go-/throw-clock timer may cease to be displayed on display 204 and a play clock timer may be displayed in its place.

Figure 5:
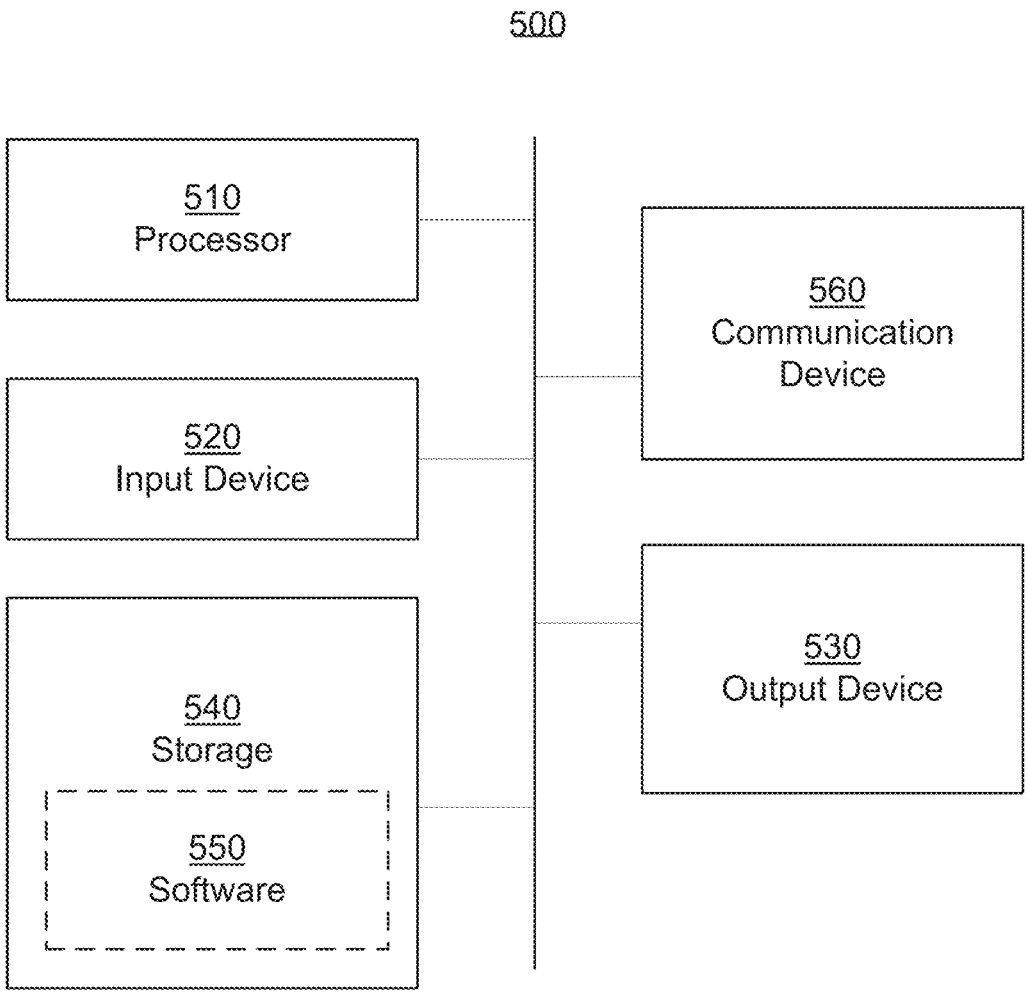
FIG. 5 shows a computer, in accordance with some embodiments.

FIG. 5 illustrates an example of a computer in accordance with one embodiment. Computer 500 can be a component of a flag football down marker and or an associated electronic device or system, such as marker 102, marker 104, marker 106, marker 200, marker 302, any one of markers 304, any one or more components of set 306, and/or football 308. In some embodiments, computer 500 is configured to execute a method for operating a multi-timer electronic football sideline marker, in accordance with some embodiments, such as all or part of method 400 as discussed above.

Computer 500 can be a host computer connected to a network. Computer 500 can be a client computer or a server. As shown in FIG. 5, computer 500 can be any suitable type of microprocessor-based device, such as a personal computer, workstation, server, or handheld computing device, such as a phone or tablet. The computer can include, for example, one or more of processor 510, input device 520, output device 530, storage 540, and communication device 560.

Input device 520 can be any suitable device that provides input, such as a touch screen or monitor, keyboard, mouse, or voice-recognition device. Output device 530 can be any suitable device that provides output, such as a touch screen, monitor, printer, disk drive, or speaker.

Storage 540 can be any suitable device that provides storage, such as an electrical, magnetic, or optical memory, including a RAM, cache, hard drive, CD-ROM drive, tape drive, or removable storage disk. Communication device 560 can include any suitable device capable of transmitting and receiving signals over a network, such as a network interface chip or card. The components of the computer can be connected in any suitable manner, such as via a physical bus or wirelessly. Storage 540 can be a non-transitory computer-readable storage medium comprising one or more programs, which, when executed by one or more processors, such as processor 510, cause the one or more processors to execute methods described herein, such as all or part of method 400.

Software 550, which can be stored in storage 540 and executed by processor 510, can include, for example, the programming that embodies the functionality of the present disclosure (e.g., as embodied in the systems, computers, servers, and/or devices as described above). In some embodiments, software 550 can include a combination of servers such as application servers and database servers.

Software 550 can also be stored and/or transported within any computer-readable storage medium for use by or in connection with an instruction execution system, apparatus, or device, such as those described above, that can fetch and execute instructions associated with the software from the instruction execution system, apparatus, or device. In the context of this disclosure, a computer-readable storage medium can be any medium, such as storage 540, that can contain or store programming for use by or in connection with an instruction execution system, apparatus, or device.

Software 550 can also be propagated within any transport medium for use by or in connection with an instruction execution system, apparatus, or device, such as those described above, that can fetch and execute instructions associated with the software from the instruction execution system, apparatus, or device. In the context of this disclosure, a transport medium can be any medium that can communicate, propagate, or transport programming for use by or in connection with an instruction execution system, apparatus, or device. The transport-readable medium can include, but is not limited to, an electronic, magnetic, optical, electromagnetic, or infrared wired or wireless propagation medium.

Computer 500 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 500 can implement any operating system suitable for operating on the network. Software 550 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

The foregoing description, for purpose of explanation, has been described with reference to specific embodiments. The illustrative embodiments described above, however, are not intended to be exhaustive or to limit the disclosure to the precise forms disclosed. Many modifications and variations are possible in view of the above teachings. The embodiments were chosen and described to best explain the principles of the disclosed techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims.

The invention claimed is:

1. An electronic sideline marker for use in football, the sideline marker comprising:

a first display configured to display an indication of a down;

a second display configured to display one or more timers;

one or more processors; and memory storing instructions executable by the one or more processors to cause:

displaying, on the second display, a first timer; and in accordance with detecting a first input:

ceasing to display a first timer and displaying a second timer; and transmitting a first signal to one or more passive electronic sideline markers, wherein the first signal includes instructions for controlling one or more displays on the one or more passive electronic sideline markers.

2. The electronic marker of claim 1, wherein the first timer counts down from a predetermined number of seconds and is associated with a delay of game rule.

3. The electronic marker of claim 1, wherein the second timer counts up from zero seconds and is associated with one or more of a go-clock rule and a throw-clock rule.

4. The electronic marker of claim 1, wherein detecting the first input comprises detecting a user pressing a button.

5. The electronic marker of claim 1, wherein detecting the first input comprises detecting a second signal received from a remote electronic device comprising instruction to cease to display the first timer and to display the second timer.

6. The electronic marker of claim 5, wherein the remote electronic device is a portable electronic device carried by a user and the second signal is transmitted from the remote electronic device to the electronic sideline marker.

7. The electronic marker of claim 1, wherein the instructions are further executable by the one or more processors to cause, in response to the first timer expiring, outputting a first indication that the first timer has expired, and transmitting a third signal to the one or more passive electronic sideline markers, the third signal comprising instructions to output a first indication that the first timer has expired.

8. The electronic marker of claim 7, wherein outputting the first indication comprises illuminating a first indicator light on the marker and one or more passive markers.

9. The electronic marker of claim 7, wherein outputting the first indication comprises outputting a first audible indication via a speaker on the marker and one or more passive markers.

10. The electronic marker of claim 1, wherein the instructions are further executable by the one or more processors to cause, in response to the second timer exceeding a first threshold, outputting a second indication that the second timer has exceeded the first threshold, and transmitting a fourth signal to the one or more passive electronic sideline markers, the fourth signal comprising instructions to output a second indication that the second timer has exceeded the first threshold.

11. The electronic marker of claim 10, wherein outputting the second indication comprises illuminating a second indicator light on the marker and one or more passive markers.

12. The electronic marker of claim 10, wherein outputting the second indication comprises outputting a second audible indication via a speaker on the marker and one or more passive markers.

13. The electronic marker of claim 10, wherein the instructions are further executable by the one or more processors to cause, in response to the second timer exceeding a second threshold greater than the first threshold, outputting a third indication that the second timer has exceeded the second threshold, and transmitting a fifth signal to the one or more passive electronic sideline markers, the fifth signal comprising instructions to output a third indication that the second timer has exceeded the second threshold.

14. The electronic marker of claim 13, wherein outputting the third indication comprises illuminating a third indicator light on the marker and one or more passive markers.

15. The electronic marker of claim 13, herein outputting the third indication comprises outputting a third audible indication via a speaker on the marker and one or more passive markers.

16. The electronic sideline marker of claim 1, wherein the first input is received via a radio frequency transmission from a radio-frequency enabled remote device in response to the radio-frequency enabled remote device receiving an instruction transmitted wirelessly from a remote electronic device.

17. The electronic marker of claim 5, wherein the remote electronic device is an electronic flag football connector configured to detect when a flag has been disconnected from a player and wherein the second signal is transmitted from the flag football connector in response to detecting that a flag has been disconnected from the player.

18. A non-transitory computer readable storage medium comprising instructions executable by one or more processors, the instructions configured to cause the one or more processors to:

at an electronic sideline marker comprising a first display configured to display an indication of a down, a second display configured to display one or more timers, and one or more processors:

display, on the second display, a first timer; and in accordance with detecting a first input:

cease to display the first timer and display a second timer; and transmit a first signal to one or more passive electronic sideline markers, wherein the first signal includes instructions for controlling one or more displays on the one or more passive electronic sideline markers.

19. A method for displaying timers for use in football, the method comprising:

at an electronic sideline marker comprising a first display configured to display an indication of a down, a second display configured to display one or more timers, and one or more processors:

displaying, on the second display, a first timer; and in accordance with detecting a first input:

ceasing to display the first timer and display a second timer; and transmitting a first signal to one or more passive electronic sideline markers, wherein the first signal includes instructions for controlling one or more displays on the one or more passive electronic sideline markers.

20. An electronic flag football equipment set comprising:

a primary electronic sideline marker and one or more secondary electronic sideline markers, wherein the primary electronic sideline marker comprises:

a first display configured to display an indication of a down;

a second display configured to display one or more timers;

one or more processors; and memory storing instructions executable by the one or more processors to cause:

displaying, on the second display, a first timer; and in accordance with detecting a first input:

ceasing to display a first timer and displaying a second timer; and transmitting a signal to one or more passive electronic sideline markers, wherein the output signal includes instructions for controlling one or more displays on the one or more secondary electronic sideline markers.

* * * * *